US005793303A

United States Patent [19]

Koga

[11] Patent Number: 5,793,303

[45] Date of Patent: Aug. 11, 1998

[54] RADIO PAGER WITH TOUCH SENSITIVE DISPLAY PANEL INACTIVE DURING MESSAGE RECEPTION

[75] Inventor: Kuniaki Koga, Shizuoka, Japan

[73] Assignee: NEC Corporation, Tokyo, Japan

[21] Appl. No.: 666,202

[22] Filed: Jun. 20, 1996

[30] Foreign Application Priority Data

Jun. 20, 1995 [JP] Japan ..... 7-153160

[51] Int. Cl.[6] ..... G08B 5/22

[52] U.S. Cl. ..... 340/825.44; 455/31.2; 455/38.4; 345/173

[58] Field of Search ..... 178/18, 17 C; 84/653; 345/173, 174; 379/58; 340/825.44; 348/239; 455/38.2, 38.3, 38.4

[56] References Cited

U.S. PATENT DOCUMENTS 5,543,588 8/1996 Bissett et al. ..... 178/18

FOREIGN PATENT DOCUMENTS 2-156322 6/1990 Japan .

*Primary Examiner*—Edwin C. Holloway, III
*Assistant Examiner*—Arthur Farabee
*Attorney, Agent, or Firm*—Sughrue, Mion, Zinn, Macpeak & Seas, PLLC

[57] ABSTRACT

In a radio display pager, the display panel is overlaid with a touch sensitive film and a scan pulse generator is provided. When receiving a paging signal and storing a received message, the scan pulse generator is inactive to avoid interference. The scan pulse generator is activated when a physical key is manually operated for displaying virtual keys by applying a first scan pulse to one end of each horizontal path of the touch sensitive film and a second scan pulse to one end of each vertical path of the film. A pair of coordinate signals is derived from the scan pulse outputs from the other ends of the horizontal and vertical paths. When one of the virtual keys is operated, coordinate signals representing its position are produced and, in response, a corresponding message in the memory is displayed. The scan pulse generator is deactivated when the physical key is operated again.

6 Claims, 2 Drawing Sheets

RADIO PAGER WITH TOUCH SENSITIVE DISPLAY PANEL INACTIVE DURING MESSAGE RECEPTION

BACKGROUND OF THE INVENTION

1. Field of the Invention

The present invention relates generally to selective calling radio display pagers, and more specifically to a radio display pager having a touch sensitive display panel for displaying virtual keys as well as received messages.

2. Description of the Related Art

For hand-held radio display pagers, the amount of space for mounting keys is severely limited. There is still a demand for adding a variety of new features to pagers to increase their cost performance. However, this would require new keys, making the space limitation problem acute. This problem is solved by an approach disclosed by Japanese Laid-Open Patent Specification Hei-2-156322. According to this specification, virtual keys are created on a touch sensitive display panel. For sensing the position of an operated virtual key, one method is to apply scan pulses to a touch sensitive film and to derive a pair of coordinate signals from the pulses output from the film. However, due to interference from the harmonics of the scan pulses, the performance of the pager's radio frequency section is severely affected.

SUMMARY OF THE INVENTION

It is therefore an object of the present invention to provide a selective calling radio display pager with a touch sensitive display panel which is rendered inactive during the reception of paging signals to maintain the performance of the pager at an acceptable level.

A method for operating a selective calling radio display pager comprising a display panel, a touch sensitive film overlying the display panel, scanning means for applying, when activated, a first scan pulse to one end of each of parallel horizontal paths of the touch sensitive film and applying a second scan pulse to one end of each of parallel vertical paths of the touch sensitive film and producing a pair of coordinate signals from the first and second scan pulses delivered from the other ends of the horizontal and vertical paths, and a manually operated physical key, the method comprising the steps of:

a) receiving a message having an address corresponding to an address of the pager and storing the received message into a memory while keeping the scanning means in an inactive state;

b) determining whether the physical key is operated or not;

c) if the physical key is determined to be operated, activating the scanning means and if the physical key is determined to be not operated, repeating the step (a);

d) displaying virtual keys on the display panel; and e) displaying a message stored in the memory on the display panel in response to the coordinate signals from the scanning means representing the position of one of the virtual keys which is manually operated.

The scanning means is deactivated again in response to an operation of the physical key that occurs following the step (e).

BRIEF DESCRIPTION OF THE DRAWINGS

The present invention will be described in further detail with reference to the accompanying drawings, in which.

DETAILED DESCRIPTION

Figure 1:
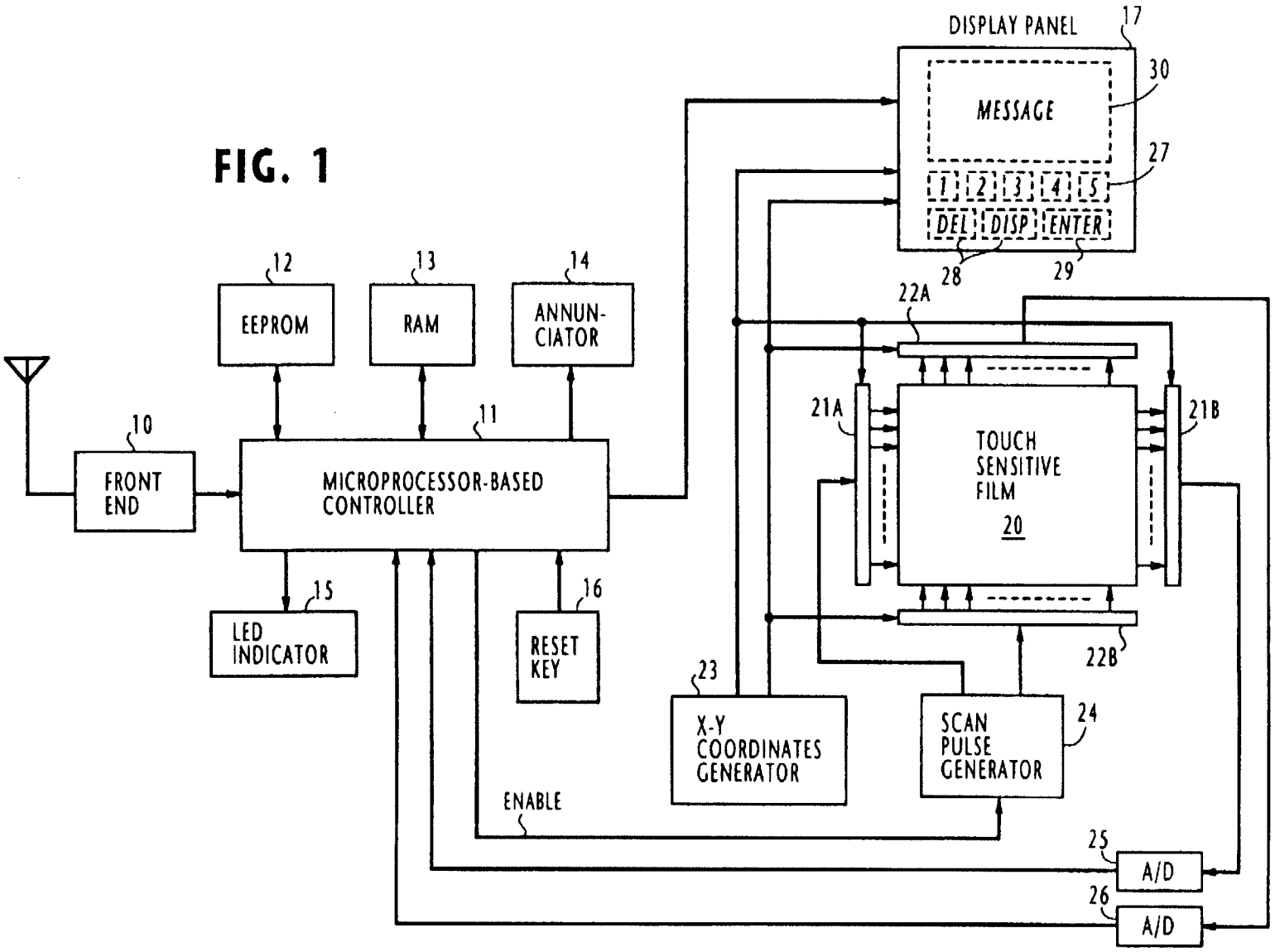
FIG. 1 is a block diagram of a selective calling radio display pager according to the present invention.

Referring to FIG. 1, a hand-held, selective calling radio display pager according to the present invention is illustrated as comprising a radio frequency section, or front end 10 for receiving a broadcast radio paging signal and converting it to a baseband signal. The calling address contained in the received paging signal is compared by a microprocessor-based controller 11 with the pager's address stored in an address memory 12 implemented with an EEPROM (electrically erasable programmable read only memory). If they match, controller 11 stores the received message into a message memory implemented with a random-access memory 13. An annunciator 14 and a light emitting diode indicator 15 are then activated to audibly and visually alert the user of the arrival of a message. A reset key 16, when operated by the alerted user, causes the controller 11 to deactivate the annunciator and the LED indicator.

A liquid crystal display panel 17 is provided to display graphic and textual data supplied from controller 11. A LCD panel 17 is overlaid with a touch sensitive film 20 of transparent and electrically resistive material. Vertical gate arrays 21A and 21B are connected respectively to the left and right edges of the touch sensitive film 20 and horizontal gate arrays 22A and 22B are connected to the top and bottom of the film, respectively. An X-Y coordinates generator 23 supplies an X-axis position indicating signal to the gate arrays 21A and 21B and a Y-axis position indicating signal to the gate arrays 22A and 22B to sequentially select a pair of opposed gates in the arrays 21A and 21B and a pair of opposed gates in the arrays 22A and 22B so that a plurality of pressure sensitive areas are defined on the film 20 in the form of a matrix. These X-Y coordinates signals are also supplied to the LCD panel 17.

A scan pulse generator 24 is enabled by the controller 11 to supply a horizontal scan pulse sequence to the gate array 21A and a vertical scan pulse sequence to the gate array 22B. A horizontal scan pulse is allowed to pass through a sequentially selected gate of the array 21A and propagates through the film and exits the corresponding gate of array 21B to an analog-to-digital converter 25. Simultaneously, a vertical scan pulse is likewise allowed to pass through a sequentially selected gate of the array 22B and propagates through the film and exits the corresponding gate of array 22A to an analog-to-digital converter 26. As will be described, when the scan pulse generator 24 is enabled by the controller, an array of virtual message (number) keys 27, command (delete and display) keys 28 and an enter key 29 are displayed on the LCD panel 17. A message stored in memory 12 is displayed within an area 30 defined in the LED display panel 17. When the user depresses one of the virtual keys 27, a portion of the film 20 corresponding to the depressed key varies its impedance and the amplitudes of the horizontal and vertical scan pulses which propagate along the paths intersecting that portion are varied accordingly, thus translating the depressed virtual key position into a pair of analog coordinate amplitude signals. These coordinate signals appear at the outputs of the gate arrays 21B and 22A and supplied to A/D converters 25 and 26, respectively, where they are converted to digital signals and applied to controller 11.

Figure 2:
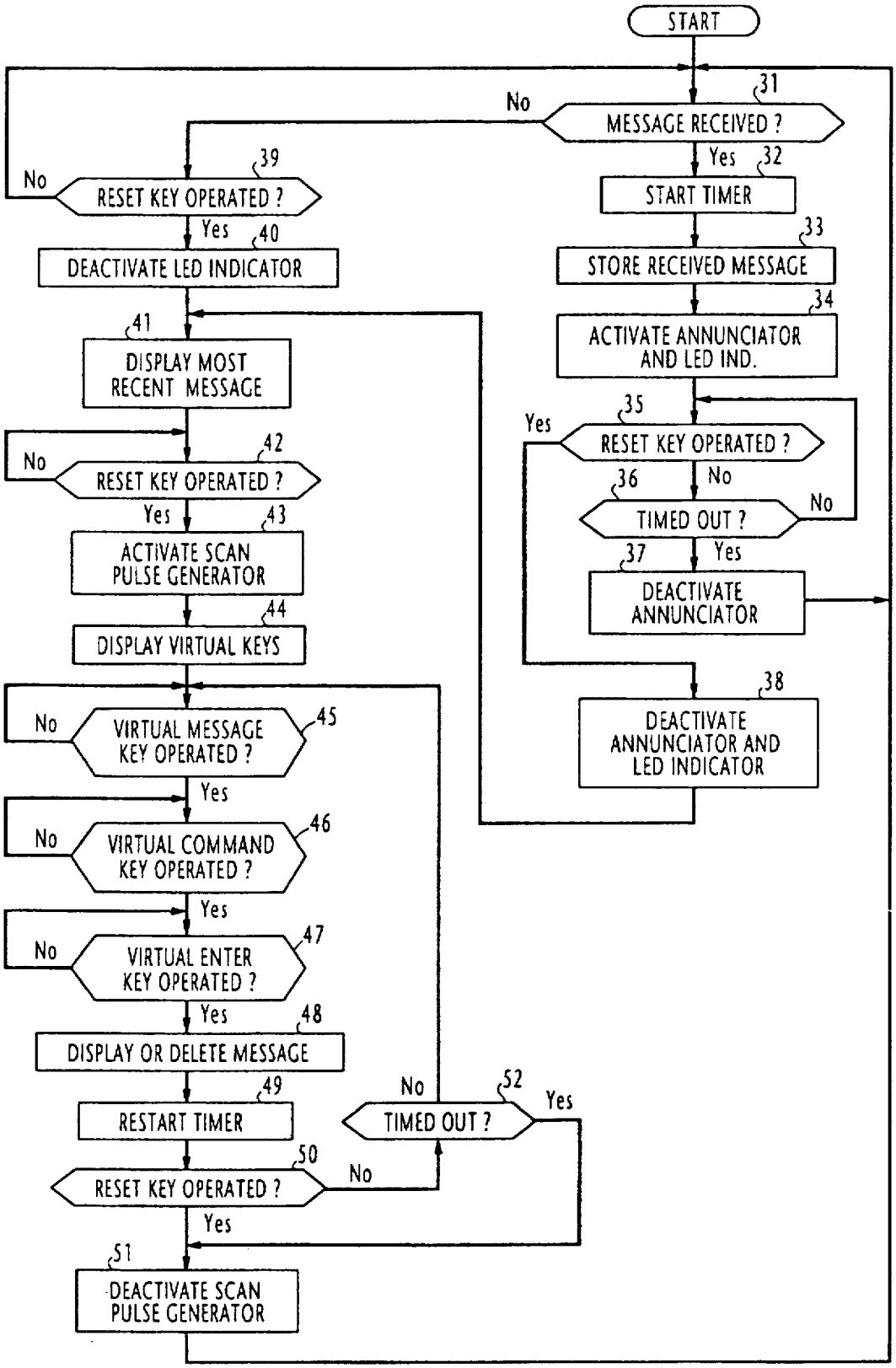
FIG. 2 is a flowchart illustrating the operation of the microprocessor-based controller of FIG. 1.

The operation of the controller 11 will be described with the aid of the flowchart shown in FIG. 2.

During a standby state, controller 11 repeatedly loops steps 31 and 39 to check for the reception of a message having the same address as that stored in the address memory 12 and for the operation of the reset key 16. During the standby state, the scan pulse generator 24 is kept inactive. No interfering noise is thus produced by the scan pulse generator 24 when the pager is ready to receive a paging signal. When a message destined to the pager is received, flow proceeds from step 31 to step 32 where the controller begins a timing operation. At step 33, controller 11 stores the received message into a vacant entry of the message memory 13. Controller 11 then activates the annunciator 14 and the LED indicator 15 to alert the pager's user (step 34). Flow proceeds to step 35 to determine whether or not the reset key 16 is operated. If not, flow proceeds to step 36 to check for the expiration of the timing action. If the user does not operate the key 16 within the period of the timing action, flow proceeds from step 36 to step 37 to deactivate the annunciator, leaving the LED indicator 15 activated. Following the execution of step 37, flow returns to the standby state to repeat steps 31 and 39.

If the user operates the key 16 within the period of the timing action, flow proceeds from step 35 to step 38 to deactivate both annunciator 14 and LED indicator 15, and flow proceeds to step 41. If the user operates the key 16 after recognizing that LED indicator 15 is being activated, flow proceeds from step 39 to step 40 to deactivate the LED indicator and proceeds to step 41.

At step 41, the message most recently stored in message memory 13 is displayed, and flow proceeds to step 42 to check to see if the reset key 16 is operated again. If the decision at step 42 is affirmative, flow proceeds to step 43 where the controller activates the scan pulse generator 24 and displays virtual keys 27 on LCD panel 17 (step 44). If one of the virtual message keys 27 is operated for selecting a stored message (step 45), and if one of the virtual command keys (delete or display) 28 is subsequently operated for entering a delete or display command (step 46) and the virtual enter key 29 is finally operated (step 47) for confirmation, controller 11 stores the coordinate signals generated from A/D converters 25, 26 as each of these steps is executed. Flow then proceeds to step 48 to display or delete a stored message according to coordinate signals produced each time a virtual key is operated at each of steps 45, 46 and 47. At step 49, controller 11 restarts a timing action. If the reset key 16 is operated at step 50, flow proceeds to step 51 to deactivate the scan pulse generator 51 and returns to the starting point of the program. If the reset key is not operated, flow proceeds from step 50 to step 52 to check for the expiration of the timing action. If the decision at step 52 is negative, flow returns to step 45 to allow the user to operate the virtual keys 27, 28 and 29 again and reset the timing action. If the timing action expires before the reset key is operated, flow proceeds from step 52 to step 51 to deactivate scan pulse generator 24. After the execution of step 51, flow returns to step 31.

Since the scan pulse generator 24 is inactive when the pager is receiving paging signals, there is no possibility that the front end 10 is interfered with by the harmonics of the scan pulses.

What is claimed is:

1. A selective calling radio display pager comprising:

a display panel;

a touch sensitive film overlying the display panel;

scanning means for applying, when activated, a first scan pulse to one end of each of parallel horizontal paths of said touch sensitive film and applying a second scan pulse to one end of each of parallel vertical paths of said touch sensitive film and producing a pair of coordinate signals from the first and second scan pulses delivered from the other ends of the horizontal and vertical paths;

receive means for receiving messages having an address corresponding to an address of the pager when the scanning means is inactive;

a memory;

a physical key; and control means for storing the received messages into said memory when the scanning means is inactive, for switching the scanning means to active state in response to manual operation of the physical key, for displaying virtual keys on said display panel when said scanning means is in the active state, and for displaying a message stored in the memory on said display panel in response to the coordinate signals from the scanning means representing the position of one of the virtual keys which is manually operated.

2. A selective calling radio display pager as claimed in claim 1, wherein the control means includes means for switching said scanning means to inactive state again when the physical key is operated after said one of the virtual keys is operated.

3. A method for operating a selective calling radio display pager comprising a display panel, a touch sensitive film overlying the display panel, scanning means for applying, when activated, a first scan pulse to one end of each of parallel horizontal paths of said touch sensitive film and applying a second scan pulse to one end of each of parallel vertical paths of said touch sensitive film and producing a pair of coordinate signals from the first and second scan pulses delivered from the other ends of the horizontal and vertical paths, and a manually operated physical key, the method comprising the steps of:

a) receiving a message having an address corresponding to an address of the pager and storing the received message into a memory while keeping said scanning means in an inactive state;

b) determining whether the physical key is operated or not;

c) if the physical key is determined to be operated, activating said scanning means and if the physical key is determined to be not operated, repeating the step (a);

d) displaying virtual keys on the display panel; and e) displaying a message stored in the memory on said display panel in response to the coordinate signals from the scanning means representing the position of one of the virtual keys which is manually operated.

4. A method as claimed in claim 3, further comprising, after the step (e), deactivating said scanning means in response to operation of the physical key.

5. A method as claimed in claim 3, further comprising, between the steps (a) and (b), the steps of:

a1) activating an annunciator; and a2) deactivating the annunciator and displaying a message most recently stored in the memory on said display panel in response to operation of the physical key.

6. A selective calling radio display pager comprising:

a display panel;

a touch sensitive film connected to said display panel;

a scanning mechanism having an active state and an inactive state, wherein when said scanning mechanism is in its active state said scanning mechanism determines whether said touch sensitive film is touched;

a receiver that, when said scanning mechanism is in its inactive state, receives messages having an address corresponding to an address of the pager;

a memory;

a physical key that switches said scanning mechanism between its active and inactive states; and a control unit that directs the received messages into said memory when said scanning mechanism is in its inactive state, and that displays virtual keys on said display panel when said scanning mechanism is in its active state.

* * * * *